US006143130A

United States Patent [19]

Stigsson et al.

[11] Patent Number: 6,143,130

[45] Date of Patent: Nov. 7, 2000

[54] POLYSULFIDE PULPING PROCESS

[75] Inventors: Lars Stigsson, Saltsjöbaden; Mikael Linström, Stockholm, both of Sweden

[73] Assignee: Kvaerner Pulping AB, Karlstad, Sweden

[21] Appl. No.: 08/992,114

[22] Filed: Dec. 17, 1997

[30] Foreign Application Priority Data

Sep. 9, 1997 [SE] Sweden ..... 9703365

[51] Int. Cl.[7] ..... D21C 11/00

[52] U.S. Cl. ..... 162/29; 162/30.1; 162/42; 162/45; 162/82

[58] Field of Search ..... 162/19, 29, 30.1, 162/30.11, 31, 41, 42, 45, 82, DIG. 2; 423/562, 642

[56] References Cited

U.S. PATENT DOCUMENTS

| | | | |
|---|---|---|---|
| 2,639,987 | 5/1953 | Sloman | 92/13 |
| 3,331,732 | 7/1967 | Venemark | 162/30 |
| 3,526,666 | 9/1970 | Ponder | 260/591 |
| 3,567,572 | 3/1971 | Clayton | 162/19 |
| 3,650,888 | 3/1972 | Eogman | 162/29 |
| 3,664,919 | 5/1972 | Clayton et al. | 162/19 |
| 3,874,991 | 4/1975 | Kleppe | 162/19 |
| 4,024,229 | 5/1977 | Smith | 423/562 |
| 4,130,457 | 12/1978 | Barker | 162/82 |
| 4,808,264 | 2/1989 | Kignell | 162/30.1 |
| 4,855,123 | 8/1989 | Suzuki | 423/562 |
| 5,660,685 | 8/1997 | Nilsson | 162/16 |

FOREIGN PATENT DOCUMENTS

| | | |
|---|---|---|
| WO 97/41294 | 11/1997 | WIPO . |
| WO9741294 | 11/1997 | WIPO . |
| WO 93/22493 | 11/1998 | WIPO . |

*Primary Examiner*—Dean T. Nguyen
*Attorney, Agent, or Firm*—Jeffrey S. Melcher

[57] ABSTRACT

A method for impregnation and chemical digestion of lignocellulosic material and recovery of pulping liquors. A spent impregnating or cooking liquor is withdrawn and sulphurous compounds are recovered therefrom in a partial oxidation reactor. These sulphurous compounds are converted into hot liquid elemental sulphur which thereafter is mixed with a hot sulphide containing liquor to provide a polysulphide liquor with a concentration greater than 10 g/l and which is essentially free from thiosulphate. This polysulphide liquor is used for carbohydrate stabilising impregnation and/or for cooking at a relatively low temperature.

23 Claims, 4 Drawing Sheets

POLYSULFIDE PULPING PROCESS

This Application claims priority to Swedish Patent Application No. 9,703,365-8, filed on Sep. 9, 1997.

1. Field of the Invention.

The present invention relates to a process for cooking a cellulosic fiber material in the presence of polysulfide and regenerating polysulfide from spent cooking liquors.

2. Background of the Invention

In recent years, the well known Kraft pulping process has been subject to many changes. It has been an ambition to extend the delignification in the cooking stage to minimize the delignification work during bleaching operations and to facilitate the replacement of chlorine chemicals with more environmentally friendly bleaching chemicals.

Extended delignification may have a negative impact on the quality of the delignified pulp and can also undesirably decrease the pulp yield. A major portion of the yield loss in the Kraft process results from the well known alkaline peeling or unzipping reactions of the carbohydrates, such as hemicellulose and cellulose. Cellulose value is also lost through alkaline extraction and splitting of glycoside linkages, thus reopening sites for secondary peeling. Alkaline extraction can take place, even at room temperature, but is enhanced by increased temperatures and high alkalinity.

The peeling reactions are automatically halted during bulk delignification for still unknown reasons, and the cellulose chain is stabilized towards further degradation by alkali. The terminal reducing aldehyde group of the hemicellulose and cellulose responsible for the initiation of peeling reactions can be eliminated by means of either reducing or oxidizing reactions.

The presence of polysulfides in the cooking liquors has been known to stabilize the hemicellulose and cellulose against peeling reactions by oxidative formation of a stable carboxyl group. This results in an increased overall pulping yield. During pulping in the presence of polysulfides, carbonyl end groups naturally present in the hemicellulose are oxidized to alkali stable gluconic acid end groups in accordance with the following equilibrium reaction:

$$2RCHO+2Na_2S_2+6NaOH \leftrightharpoons 2RCOONa+4Na_2S+4H_2O \quad (1)$$

The gluconic acid end groups stabilize the polysaccharide during pulping. The reduction in polysaccharide degradation results in a higher yield when pulping is performed to a given kappa number or results in a lower kappa number when pulping is performed to a fixed yield. The increased pulp yield in polysulfide Kraft processes is mainly a result of glucomannan stabilization in softwoods and xylan stabilization in hardwoods.

Anthraquinone addition to polysulfide pulping processes has been shown to further increase pulp yield.

The pulping of wood and other cellulosic fiber materials using polysulfide containing liquors is now well known in the art. For example in U.S. Pat. No. 3,664,919, polysulfide impregnation is carried out at an application level of 6 percent polysulfide on wood. U.S. Pat. No. 3,567,572 discloses a multi-step process in which polysulfide is applied in the absence of alkali. U.S. Pat. No. 4,130,457 describes a vapor phase polysulfide process where pulping is carried out at a low temperature for a short period of time. However, none of these patents describes the combination of a practical polysulfide pulping and polysulfide regeneration method to be used in conjunction with a Kraft pulping process.

The use of black liquor for impregnation has been practiced at mill scale for a long time in batch digester systems and more recently also in continuous digesters. The use of the effective alkali from spent pulping liquor recycled from the latter parts of the cooking stage to impregnation and initial delignification, combined with a high charge of fresh alkali after impregnation and black liquor extraction to recovery, has been described for soda and Kraft pulping in U.S. Pat. No. 2,639,987.

Up to the present time, the present inventors are unaware of a polysulfide pulping process which provides enhanced polysulfide stabilizing conditions and alkali profile throughout digestion, with or without recycled liquors, in combination with a practical polysulfide regeneration method.

In spite of the lack of practical polysulfide recovery methods, polysulfide pulping was practiced in a few mills in the 1960's by simply adding powdered sulfur to the white liquor, according to the following reaction:

$$nS^0+HS^-+OH^- \rightarrow SnS^{2-}+H_2O \quad (2)$$

Although successful in terms of yield gain, this sulfur addition resulted in an intolerable imbalance of sodium and sulfur in the mill. Until a way to overcome this obstacle could be found, this is not a viable process.

U.S. Pat. No. 3,874,991 describes a process where external sulfur, in a molten state, is added to a combined spent polysulfide solution-hydroxyl ion depleted white liquor extracted after impregnation for preparation of a polysulfide cooking liquor. This liquor is used for impregnation of the wood chips at a temperature below digestion temperatures, from 90 to 140° C., preferably from 100 to 130° C. This process suffers from an intolerable imbalance between sodium and sulfur in the mill.

Several attempts has been made to generate the polysulfide chemicals from the various forms of sulfur available in the pulping and recovery cycle to avoid the sulfur imbalance obstacle. For example, U.S. Pat. No. 3,331,732 discloses treating green liquor in a scrubber with flue gas. The carbonated green liquor is then treated in a stripper to evolve hydrogen sulfide gas, which is then further treated in a Claus type reactor to produce elemental sulfur.

U.S. Pat. No. 3,650,888, describes a polysulfide recovery process based on vacuum stripping a carbonated spent liquor to evolve hydrogen sulfide for further conversion to sulfur.

Recovery processes based on carbonation of pulping liquors to evolve hydrogen sulfide have an undesirably high degree of complication, including operating difficulties such as encrustation in green liquor pipes and lignin precipitation in the case of black liquor carbonation. Furthermore, the cost of equipment is high. Polysulfide recovery concepts based on carbonation of pulping liquors have not been commercialized.

One step towards introduction of polysulfide pulping into the Kraft pulping industry was taken during the mid seventies based on the development of catalysts capable of oxidizing the sulfur present in white liquor to form polysulfides. This concept eliminated the need to add elemental sulfur to Kraft liquor to generate the polysulfide sulfur species.

Today at least four processes are available on the market for polysulfide generation by partial oxidation of white liquor. U.S. Pat. No. 4,024,229 describes a partial white liquor oxidation process based on air oxidation using a wet proofed activated carbon bed to promote formation of polysulfides. A similar process based on polysulfide preparation by partial oxidation in a packed bed reactor with small porous active carbon granules is described in U.S. Pat. No. 4,855,123. More recently partial white or green liquoroxidation processes have been suggested based on manganese additions to the liquors to enhance partial oxidation selectivity towards polysulfide.

The partial oxidation processes are based on the same principal chemistry, as shown in the following chemical reaction:

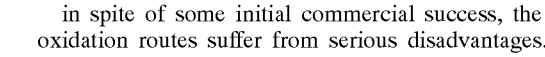

$$2Na_2S+O_2+2H_2O \leftrightarrows 2S^0+4NaOH \quad (3)$$

The elemental sulfur then reacts with sodium sulfide to form polysulfide in the white liquor in accordance with reaction 2.

in spite of some initial commercial success, the partial oxidation routes suffer from serious disadvantages. Competing side reactions during oxidation resulting in formation of inert thiosulfate cannot be avoided, as shown by the following reaction:

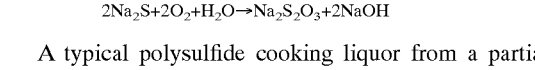

$$2Na_2S+2O_2+H_2O \rightarrow Na_2S_2O_3+2NaOH \quad (4)$$

A typical polysulfide cooking liquor from a partial white liquor oxidation process contains at the most 6 to 10 grams/liter of active polysulfide sulfur and a significant quantity of inert thiosulfate. The active sulfide content is lowered substantially with a negative impact on pulping performance and product pulp strength properties.

Furthermore, to achieve a significant yield increase, substantially all white (or green) liquor must be partially oxidized and consequently all effective alkali has to be charged to the digester in combination with the polysulfide.

The efficiency of white liquor partial oxidation systems using carbon catalysts is very sensitive to the content of suspended solids in white (or green) liquor fed to the reactor and thus very clear liquors are required.

There is a need for a process which provides an efficient polysulfide pulping process in combination with efficient polysulfide regeneration, which avoids the disadvantages inherent in prior art direct sulfur application and partial white liquor oxidation systems.

SUMMARY OF THE INVENTION

It is an objective of the present invention to provide a process which provides efficient polysulfide cooking in combination with efficient polysulfide regeneration, which avoids the disadvantages inherent in prior art direct sulfur application and partial white liquor oxidation systems.

This objective and other objectives are surprisingly obtained by the following. The present invention provides a novel process for polysulfide regeneration comprising the steps of:

(a) impregnating a cellulosic fiber material with a first cooking liquor comprising polysulfide, wherein the first cooking liquor provides about 60% or less of a total effective alkari utilized for cooking the cellulosic fiber material;

(b) cooking the cellulosic fiber material with a second cooking liquor in one or more cooking stages, wherein the second cooking liquor provides at least about 40% of the total effective alkali utilized for cooking the cellulosic fiber material;

(c) extracting a spent cooking liquor comprising sulfide compounds from at least one of the impregnating step (a) or the cooking step (b);

(d) gasifying at least a portion of the spent cooking liquor from step (c) in a gasification reactor to form a first gas stream comprising hydrogen sulfide;

(e) treating the first gas stream to form an acidic gas stream comprising hydrogen sulfide and carbon dioxide;

(f) reacting the acidic gas stream under conditions to provide a hot liquid stream of elemental sulfur;

(g) admixing at least a portion of the hot liquid, elemental sulfur stream with an alkaline liquor containing sulfide under conditions that the elemental sulfur reacts with the sulfide to form polysulfide, whereby an alkaline liquor containing at least about 10 grams/liter of polysulfide and which is substantially free of thiosulfate is formed; and (h) adding at least a portion of the alkaline polysulfide liquor to the first cooking liquor or directly to the impregnation step (a) to stabilize carbohydrates in the cellulosic fiber material.

The present invention also provides a novel process for polysulfide cooking in combination with polysulfide regeneration comprising the steps of:

(a) impregnating a cellulosic fiber material with a first cooking liquor comprising polysulfide, wherein the first cooking liquor provides about 60% or less of a total effective alkali utilized for cooking the cellulosic fiber material;

(b) cooking the cellulosic fiber material with a second cooking liquor in one or more cooking stages under conditions such that at least about 30% of the polysulfide supplied to the cooking step (b) remains intact in the spent cooking liquor following completion of cooking, wherein the second cooking liquor provides at least about 40% of the total effective alkali utilized for cooking the cellulosic fiber material;

(c) extracting a spent cooking liquor comprising the intact polysulfide and sulfide compounds from the cooking step (b);

(d) gasifying at least a portion of the spent cooking liquor extracted from step (c) or at least a portion of a spent liquor extracted after the impregnation step (a) in a gasification reactor to form a first gas stream comprising hydrogen sulfide;

(e) treating the first gas stream to form an acidic gas stream comprising hydrogen sulfide and carbon dioxide;

(f) reacting the acidic gas stream under conditions to provide a hot liquid stream of elemental sulfur;

(g) admixing at least a portion of the hot liquid, elemental sulfur stream with an alkaline liquor containing sulfide under conditions that the elemental sulfur reacts with the sulfide to form polysulfide, whereby an alkaline polysulfide liquor containing at least about 10 grams/liter of polysulfide and which is substantially free of thiosulfate is formed;

(h) utilizing at least a portion of a spent liquor containing intact polysulfide from the step (c) as the first cooking liquor;

(i) adding at least a portion of the alkaline polysulfide liquor from step (g) to the second cooking liquor or directly to the one or more cooking stages in step (b); and (j) adding a portion of the polysulfide liquor to the first cooking liquor or directly to the impregnation step (a) to provide a desired polysulfide concentration in the impregnation stage when the amount of polysulfide supplied by the spent cooking liquor in step (h) is below an amount sufficient to provide the desired polysulfide concentration in the impregnation stage.

DETAILED DESCRIPTION OF PREFERRED EMBODIMENTS

Figure 1:
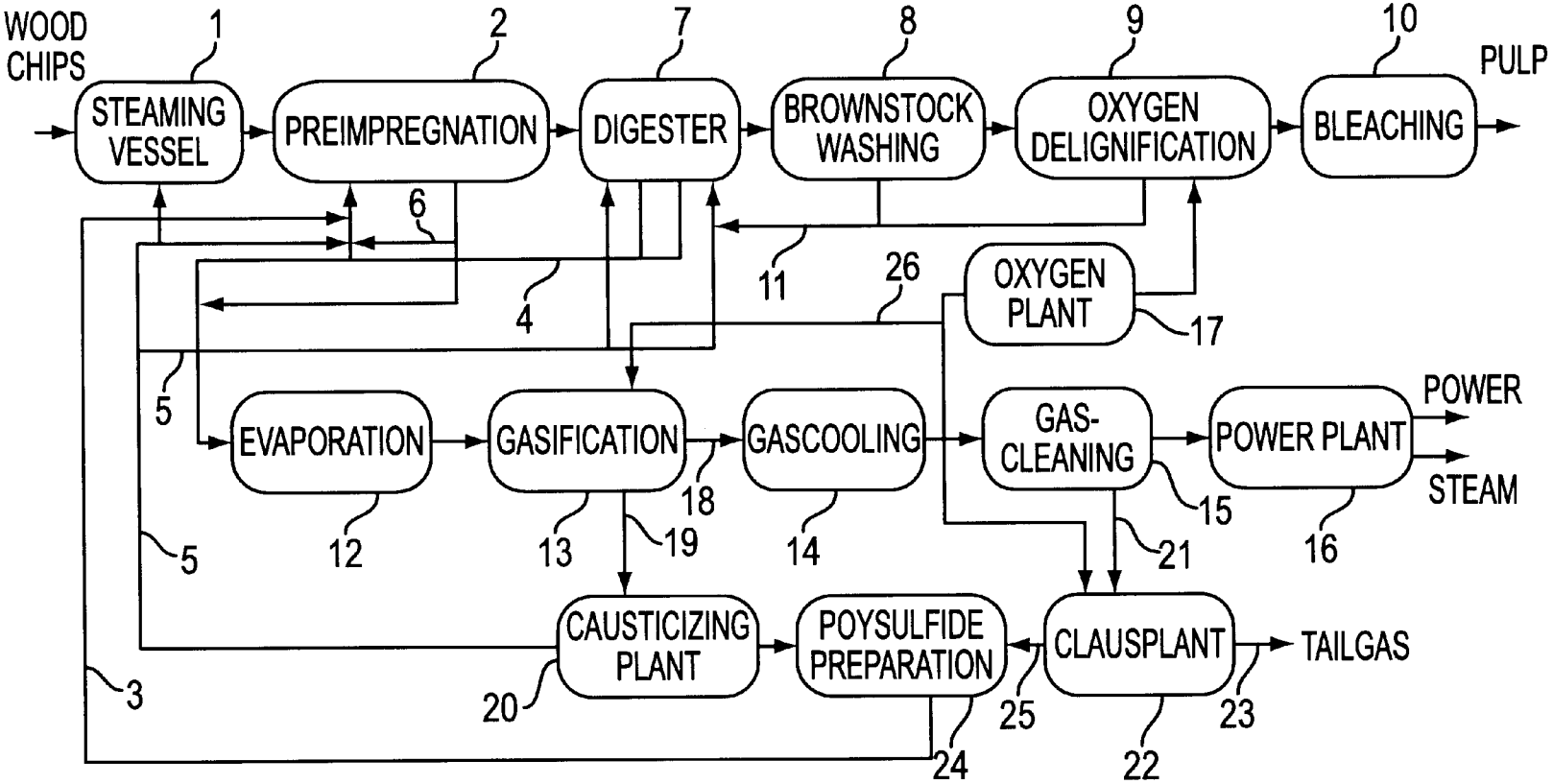
FIG. 1 illustrates the different unit operations in a Kraft mill utilizing polysulfide cooking and polysulfide regeneration in accordance with the present invention.

The improved polysulfide regeneration process according to the present invention comprises the steps of:

(a) impregnating a cellulosic fiber material with a first cooking liquor comprising polysulfide, wherein the first cooking liquor provides about 60% or less of a total effective alkali utilized for cooking the cellulosic fiber material;

(b) cooking the cellulosic fiber material with a second cooking liquor in one or more cooking stages, wherein the second cooking liquor provides at least about 40% of the total effective alkali utilized for cooking the cellulosic fiber material;

(c) extracting a spent cooking liquor comprising sulfide compounds from at least one of the impregnating step (a) or the cooking step (b);

(d) gasifying at least a portion of the spent cooking liquor from step (c) in a gasification reactor to form a first gas stream comprising hydrogen sulfide;

(e) treating the first gas stream to form an acidic gas stream comprising hydrogen sulfide and carbon dioxide;

(f) reacting the acidic gas stream under conditions to provide a hot liquid stream of elemental sulfur;

(g) admixing at least a portion of the hot liquid, elemental sulfur stream with an alkaline liquor containing sulfide under conditions that the elemental sulfur reacts with the sulfide to form polysulfide, whereby an alkaline liquor containing at least about 10 grams/liter of polysulfide and which is substantially free of thiosulfate is formed; and (h) adding at least a portion of the alkaline polysulfide liquor to the first cooking liquor or directly to the impregnation step (a) to stabilize carbohydrates in the cellulosic fiber material.

The cellulosic fiber material is contacted with the first cooking liquor in a separate impregnation zone, which may be a top portion of a continuous digester or a separate impregnation vessel. Alternatively, the polysulfide liquor can be added directly to the impregnation vessel. The cellulosic fiber material should be contacted with the polysulfide under conditions such that the cellulosic fiber material is stabilized against undesirable peeling reactions by oxidation of the cellulose aldehyde end groups to more stable carboxylic groups. Based on the disclosure provided herein, one skilled in the art can easily determine the conditions required to provide this carbohydrate stabilization. This carbohydrate stabilization provides a higher content of hemicellulose in the pulp product and a higher overall pulp yield.

The first cooking liquor should comprise about 60% or less of the total effective alkali utilized in the overall delignification process to form delignified pulp.

The second cooking liquor introduced after the impregnation zone comprises an alkaline solution, such as a low sulfidity white liquor. Cooking is performed in accordance with well known practices to the desired kappa level. Suitable cooking temperatures are from about 120 to about 175° C.

The second cooking liquor should comprise at least about 40%, preferably at least about 60%, of the total effective alkali utilized in the overall delignification process to provide delignified pulp.

The second cooking liquor can be added at various locations during bulk and final delignification, and it can be diluted with wash liquor to provide the desired alkalinity and liquor-to-wood ratio. Apart from the description provided herein, the design of the cooking stages are not critical and the overall process described in the present invention may be practiced in all modern cooking systems including single and dual vessel steam liquor phase and hydraulic continuous digesters, as well as modified batch systems.

If desired, a steam vapor phase zone can be provided after impregnation to further stabilize the carbohydrates before injection of the second cooking liquor to the digester. For example, the cellulosic fiber material can be treated with steam at a temperature of from about 130 to about 175° C., for a period of from about 5 to about 30 minutes after the impregnation.

To prevent undesirable operational problems downstream of the digester, the residual alkali content in conventional Kraft cooking and modified Kraft cooking spent liquor transferred to the recovery stage should be from about six to about twelve grams per liter.

At least a portion of the spent cooking liquors extracted and withdrawn from the impregnation and/or cooking stages are gasified in a gasification reactor to extract the valuable sulfur compounds, which can be used to regenerate polysulfide. Prior to gasification, the spent cooking liquor is normally concentrated using a multi-effect evaporator system to a dryness of from about 65 to about 85%, preferably from about 70 to about 85%. An example of a suitable gasification reactor and auxiliary system for partial oxidation of spent pulping liquors is described in U.S. Pat. No. 4,808,264, the complete disclosure of which is incorporated herein by reference. Besides recovery of valuable sulfur compounds, a major task for the recovery process is an efficient conversion of the calories present in the spent cooking liquor to steam and/or power. The combustible fuel gas generated in the spent cooking liquor gasification process can advantageously be used to fuel a gas turbine power plant.

By controlling the operating conditions in the gasification reactor and by controlling the addition of oxygen containing gas, the sodium and sulfur compounds present in the spent cooking liquor can be split as desired into two separate process streams. One stream comprising reduced sulfur in the form of an aqueous solution of sodium sulfide and sodium hydrosulfide can be produced by quenching the melt in an aqueous liquid. Another stream, comprising reduced sulfur, can be discharged from the gasification reactor in the form of a combustible gas comprising hydrogen sulfide. The proportion of reduced sulfur in the two streams can be controlled, for example, by varying the reaction temperature in the reactor and the operating pressure in the reactor. Preferably, at least about 20%, more preferably, from about 30 to about 60% of the sulfur compounds supplied to the gasification reactor are recovered as sodium sulfide. Preferably, at least about 20% of the sulfur compounds supplied to the gasification reactor are recovered as hydrogen sulfide.

If desired, sulfur compounds may be added to the gasification reactor to displace the sulfur equilibrium in the gasification reactor towards the formation of sodium sulfide. Further control of the degree of sodium-to-sulfur split in the reactor could be achieved by adjusting the steam partial pressure in the reactor, for example, by atomizing steam, moderator steam, water content of the spent cooking liquor, and the like.

The aqueous sulfide containing stream discharged from the reactor can be subjected to conventional causticizing to form a low sulfidity white liquor.

The combustible gas, comprising hydrogen sulfide, can be cooled and transferred to a regenerative gas clean-up system, to provide a clean combustible gas and a separate acidic gas stream comprising hydrogen sulfide and carbon dioxide. The acidic gas stream is transferred to a Claus plant for recovery of hot liquid elemental sulfur. The conversion of acidic gases comprising hydrogen sulfide and carbon dioxide to hot liquid elemental sulfur via the Claus reaction is a well known established practice in the chemical industry. Although there are a number of reactions in the conversion of hydrogen sulfide to sulfur, the overall conversion can be represented by:

$$H_2S+\tfrac{1}{2}O_2 \rightarrow S^0+H_2O \quad (5)$$

In accordance with the present invention, it has been found that a hot elemental sulfur stream advantageously can be mixed with sulfide containing liquors, such as green liquor and white liquor, to form a polysulfide liquor. Preferably, the polysulfide containing liquor is formed from a white liquor. It has been found that substantially no thiosulfate is formed during preparation of polysulfide liquors in accordance with the present invention, even at high concentrations of polysulfides, such as greater than about 10 grams/liter.

The polysulfide liquor can be used as at least a portion of the first cooking liquor containing polysulfides as necessary to maintain the level of polysulfide in the impregnation stage and to provide the desired level of carbohydrate stabilization. Alternatively, the polysulfide liquor can be added directly to the impregnation stage to maintain the level of polysulfide therein. The desired level of polysulfide will vary depending upon the particular type of digesting to be conducted. Based on the disclosure provided herein, one skilled in the art will be able to provide and maintain the desired level of polysulfide in the impregnation stage.

The polysulfide recovery process according to the present invention provides the advantage that the polysulfide liquor can be prepared at a high concentration and consequently it can be applied as desired at effective alkali concentrations optimal for carbohydrate stabilization. Preferably, the hot liquid elemental sulfur is admixed with a hot, preferably at least about 80° C., sulfide containing liquor. It has been found that polysulfide liquors having a concentration of from about 10 up to about 100 grams per liter can be prepared for use in the present invention. Preferred ranges are however from about 15 to about 40 grams per liter.

In another embodiment of the present invention, the polysulfide liquor is utilized in the digester to provide polysulfide cooking in combination with polysulfide regeneration. The polysulfide cooking and polysulfide regeneration process according to the present invention includes the steps of:

(a) impregnating a cellulosic fiber material with a first cooking liquor comprising polysulfide, wherein the first cooking liquor provides about 60% or less of a total effective alkali utilized for cooking the cellulosic fiber material;

(b) cooking the cellulosic fiber material with a second cooking liquor in one or more cooking stages under conditions such that at least about 30% of the polysulfide supplied to the cooking step (b) remains intact in the spent cooking liquor following completion of cooking, wherein the second cooking liquor provides at least about 40% of the total effective alkali utilized for cooking the cellulosic fiber material;

(c) extracting a spent cooking liquor comprising the intact polysulfide and sulfide compounds from the cooking step (b);

(d) gasifying at least a portion of the spent cooking liquor extracted from step (c) or at least a portion of a spent liquor extracted after the impregnation step (a) in a gasification reactor to form a first gas stream comprising hydrogen sulfide;

(e) treating the first gas stream to form an acidic gas stream comprising hydrogen sulfide and carbon dioxide;

(f) reacting the acidic gas stream under conditions to provide a hot liquid stream of elemental sulfur;

(g) admixing at least a portion of the hot liquid, elemental sulfur stream with an alkaline liquor containing sulfide under conditions that the elemental sulfur reacts with the sulfide to form polysulfide, whereby an alkaline polysulfide liquor containing at least about 10 grams/liter of polysulfide and which is substantially free of thiosulfate is formed;

(h) utilizing at least a portion of a spent liquor containing intact polysulfide from the step (c) as the first cooking liquor;

(i) adding at least a portion of the alkaline polysulfide liquor from step (g) to the second cooking liquor or directly to the one or more cooking stages in step (b); and (j) adding a portion of the polysulfide liquor to the first cooking liquor or directly to the impregnation step (a) to provide a desired polysulfide concentration in the impregnation stage when the amount of polysulfide supplied by the spent cooking liquor in step (h) is below an amount sufficient to provide the desired polysulfide concentration in the impregnation stage.

In addition to known yield increases due to the presence of polysulfide during conventional cooking, it has now surprisingly been found that a significant increase in the delignification rate can be achieved when a large portion of polysulfide is present during the cooking stage and the cooking stage is conducted in a manner which stabilizes polysulfide against decomposition. To retain polysulfide at a relatively stable condition during cooking, the cooking temperature should be reduced in relation to conventional cooking temperatures. Suitable cooking temperatures for polysulfide stabilization are from about 120 to about 150° C., preferably from about 135 to about 148° C., and most preferably from about 140 to about 145° C. At these lower cooking temperatures, it has now been found that a large portion of the polysulfide remains intact in the black liquor withdrawn from the digester. In some instances, the amount of intact polysulfide is about 30% or more, preferably about 40% or more, of the initial amount of polysulfide supplied to the cooking stage. Preferably, at least a portion of this black liquor containing a significant amount of polysulfide is recycled to the initial impregnation zone to make up at least a portion of the first cooking liquor, wherein the polysulfide can be used to stabilize the cellulose. By recycling black liquor containing a significant amount of polysulfide, the amount of polysulfide liquor required in the impregnation stage can be substantially reduced. In some instances, polysulfide liquor may only have to be periodically added to the recycled black liquor to maintain a desired polysulfide concentration in the impregnation stage.

In this embodiment, a major portion of the polysulfide liquor is added to the cooking stage (b) directly or as at least a part of the second cooking liquor. For example, it has been found for some Kraft pulp processes that about 20% or less of the polysulfide liquor can be added to the impregnation stage and about 80% or more of the polysulfide liquor can be added to the cooking stage. The present invention however is not limited to these amounts of polysulfide liquor being added to the impregnation stage and cooking stage. In some instances, the polysulfide liquor is added periodically to the impregnation stage when the level of polysulfide in the impregnation stage falls below a desired amount. One skilled in the art will be able to select the desired amounts of polysulfide liquor to be added to each of the impregnation and cooking stages, based on the desired amount of polysulfide to be present during impregnation and cooking.

When the cellulosic fiber material is subjected to steam treatment prior to polysulfide digestion, a lower steam temperature should be utilized, such as from about 130 to about 150° C. The lower steam temperatures will help retain polysulfide present in the cellulosic fiber material exiting the impregnation stage. In this manner, the amount of polysulfide present during digestion will be further enhanced.

Thiosulfate is inert in Kraft cooking systems and besides the dead load can cause corrosion in digesters and impregnation vessels. Prior experiences with sulfur additions to pulping liquors in mills and in laboratories are based on addition of powdered sulfur, with causes undesirable mixing complications and side reactions with oxygen in the powder bulk. However, in the present invention the hot liquid elemental sulfur can be discharged directly into the sulfide containing liquor in a closed vessel with a minimum of contact with air or oxygen, such that undesirable sulfur oxidation reactions are substantially avoided.

Polysulfide liquors prepared in accordance with the present invention can be utilized as the first cooking liquor added to the impregnation zone alone or in combination with other liquors to establish the desired liquor-to-wood ratio and level of effective alkali charge. In a preferred embodiment of the present invention, the polysulfide liquor comprises a white liquor which has been treated with the hot liquid elemental sulfur stream to form polysulfides and the polysulfide liquor is utilized as at least a portion of the first cooking liquor. More preferably, the first cooking liquor comprises a spent cooking liquor from the cooking stage to which polysulfide liquor formed from white liquor is added in an amount necessary to establish optimum sulfur and alkali profiles in the impregnation stage.

The quantifies of fresh and spent liquors should be selected so as to provide sufficient effective alkali to sustain polysulfide and neutralization reactions during impregnation and initial delignification. Preferably, the ratio of pulping liquor to cellulosic fiber material is at least about 3.5:1.

Figure 3:
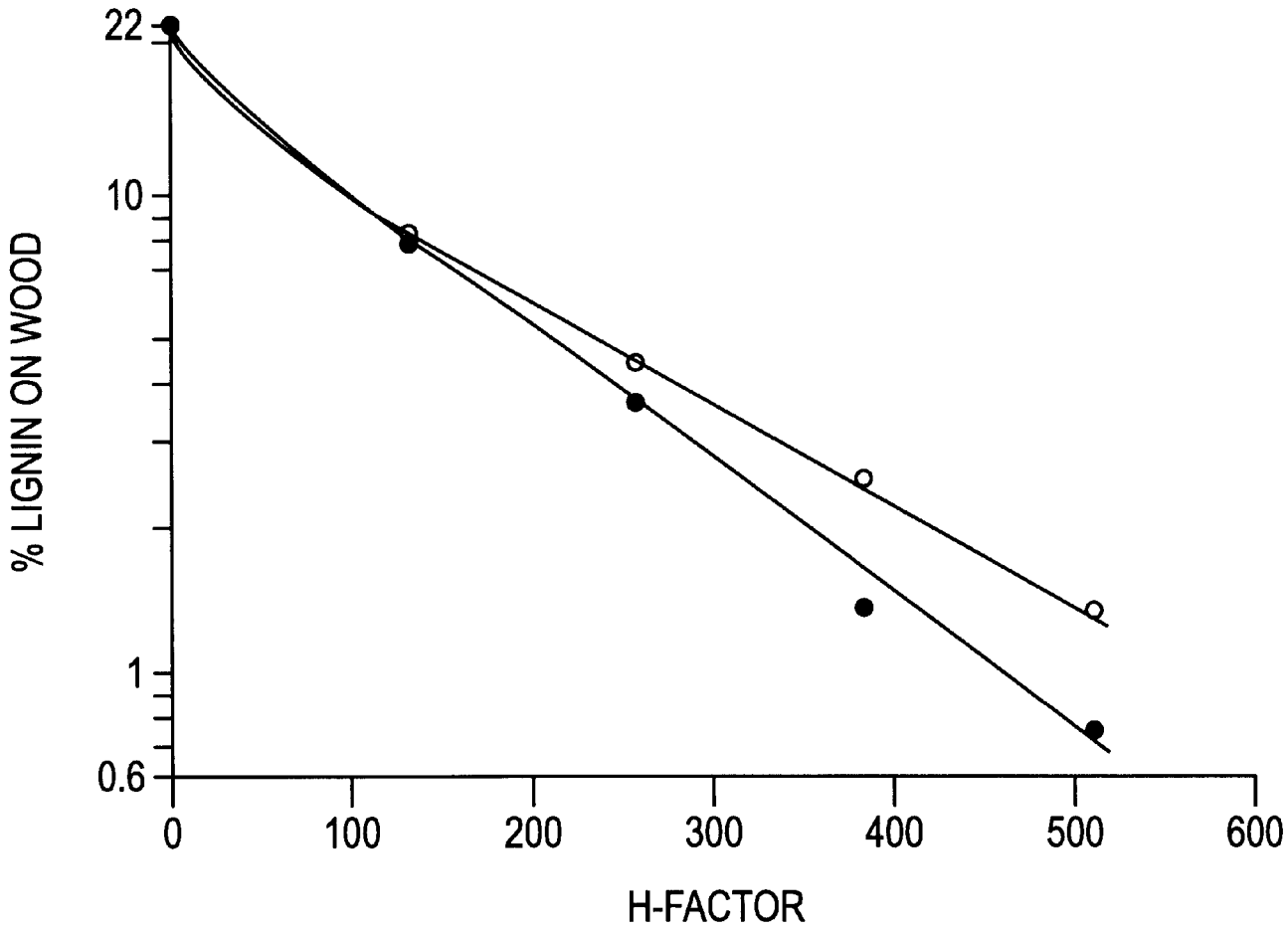
FIG. 3 is a graph of the difference in the delignification rate with (●) and without (○) polysulfide present during the first 240 minutes of Kraft cooking at 147° C.
Figure 4:
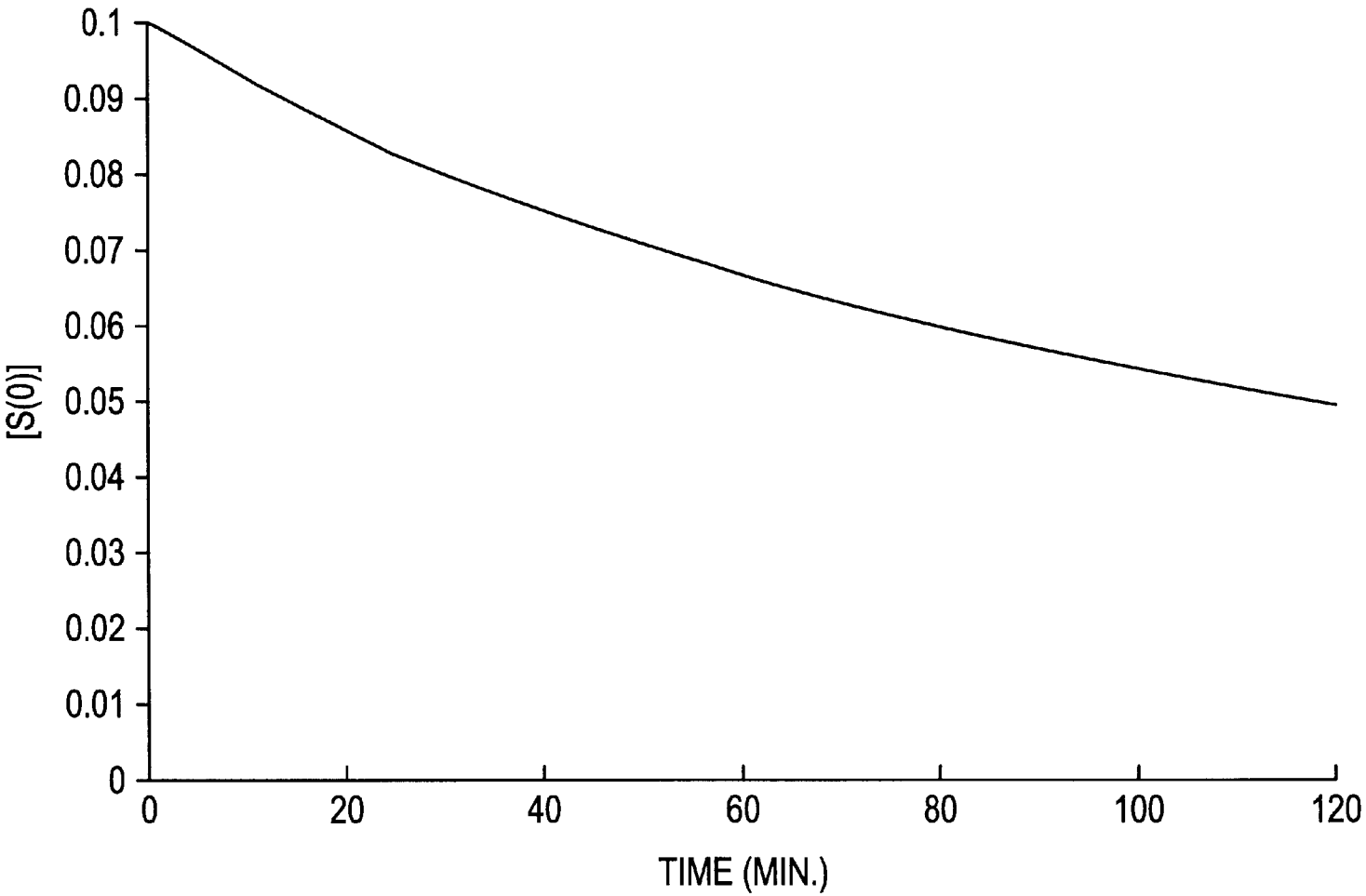
FIG. 4 is a graph of the thermal decomposition of polysulfide over a period of 120 minutes at 140° C.

A preferred embodiment of the invention is based on the surprising discovery that the delignification rate can be increased by polysulfide cooking at relatively low temperatures. In this embodiment of the invention, which is further described in connection with the FIGS. 2 through 4, a delignification rate increase in the digester is combined with a carbohydrate stabilizing effect in the pre-impregnation vessel.

With the foregoing description in mind, a number of drawings are presented which will illustrate the manner in which the invention can be carried out. However, these drawings are not to be construed as limiting the scope of the invention in any way but are provided merely to point out the efficacy of the invention in attaining an exemplary economical pulping and recovery scheme and to demonstrate a preferred utility of polysulfide yield enhancement chemicals.

An embodiment of the present invention will now be explained with the reference to the attached FIG. 1. In this embodiment, the polysulfide liquor is primary added to the impregnation stage. Wood chips or other comminuted cellulosic fiber material are transported to a chip bin and steaming vessel (1), where the material is subjected to steaming at a temperature of from about 100 to about 140° C. in order to remove air from the chip matrix. The steamed chips are discharged from the steaming vessel to a high pressure feeder system which pressurizes and transports the chip slurry from the low pressure feed system to the high pressure impregnation vessel (2).

In addition to cooking liquor comprising polysulfide (3), it is beneficial to add recycled spent cooking liquor from the digester (4) to the impregnation vessel (2). Optionally, also low sulfidity white liquor from the causticizing plant (5) and/or recycled impregnation liquor (6) is added to the impregnation vessel.

The impregnated chips are then passed to the upper section of a steam/liquor phase digester (7) where the chips are exposed to steam, raising the temperature to full cooking temperature, for example, a temperature of from about 120 to about 175° C., preferably from about 130 to about 150° C.

Low sulfidity white liquor comprising at least about 40% of the effective alkali to be used during impregnation and cooking is added through one or several conduits to the cooking circulations or directly into the digester.

The cooking and delignification reactions are allowed to proceed to a predetermined kappa number, whereafter the digested chips are discharged from the digester and passed to the brownstock washers (8). Hot spent cooking liquor (4) is extracted from the digester through extraction screens for recycle to impregnation and/or recovery of fresh cooking chemicals.

After brownstock washing, the pulp is further treated in an oxygen delignification reactor (9) and is transferred to a downstream bleach plant (10) to prepare a bleached pulp product with the desired physical properties. The filtrates (11) from the brownstock washers and oxygen delignification stage are recycled to the digester to provide the desired ratio of liquor-to-wood in the digester.

At least a portion of the spent cooking liquor extracted after impregnation and/or from the digester is withdrawn to a multi-effect evaporation system (12) and concentrated to a dry solids content of from about 70 to about 85% .

The concentrated spent cooking liquor (black liquor) is thereafter directed to an integrated black liquor gasification combined cycle plant (IGCC) for recovery of cooking chemicals and energy. This plant comprises a gasification reactor (13), a gas cooling system (14), a gas cleaning (15) system and a power generation block (16). Concentrated black liquor is injected into the gasification reactor (18) with an oxidant (26), preferably cryogenic quality oxygen from an adjacent oxygen plant (17). The oxygen sustains the partial oxidation reactions taking place in the gasification reactor, which usually operates at a temperature of from about 850 to about 1200° C. and at a pressure of from about 0.5 to about 10 MPa.

The sulfurous chemicals charged to the gasification reactors are decomposed in the reactor and split into one stream of hydrogen sulfide gas following the fuel gas stream from the gasification reactor (18) and into another stream as a melt of sodium sulfide which is dissolved into an aqueous medium and discharged from the reactor vessel as a low sulfidity green liquor (19). The latter stream is directed to a causticizing plant (20) to convert the low alkalinity green liquor into high alkalinity white liquor. At least about 20%, preferably from about 30 to about 60%, of the sulfur charged into the gasification reactor is recovered as sodium sulfide. The fuel gas stream comprising the balance of sulfur as hydrogen sulfide is cooled to a temperature below about 100° C. and directed to a regenerative gas cleaning system (15) comprising an absorber and a stripper. The fuel gas is separated from the sulfur compounds and these sulfur compounds are recovered in an acidic gas stream (21) comprising hydrogen sulfide and carbon dioxide.

The cleaned fuel gas exiting the absorber is directed to the gas-turbine power plant for recovery of power and steam. The acidic gas is transferred to an oxygen blown Claus plant (22) for recovery of hot liquid elemental sulfur.

The tailgas stream (23) from the Claus plant is discharged to an onsite sulfuric acid plant or to the odor gas handling system of the pulp mill. The temperature of the hot product liquid sulfur stream (25) is kept higher than about 120° C. and charged directly into a mixing vessel (22) filled with hot white liquor. The charge of white liquor and elemental sulfur is controlled so as to bring the concentration of polysulfide liquor produced in the mixing vessel to about 10 grams/liter or greater. The strong polysulfide liquor is supplied to the impregnation vessel as the first cooking liquor to complete the circle (3).

Figure 2:
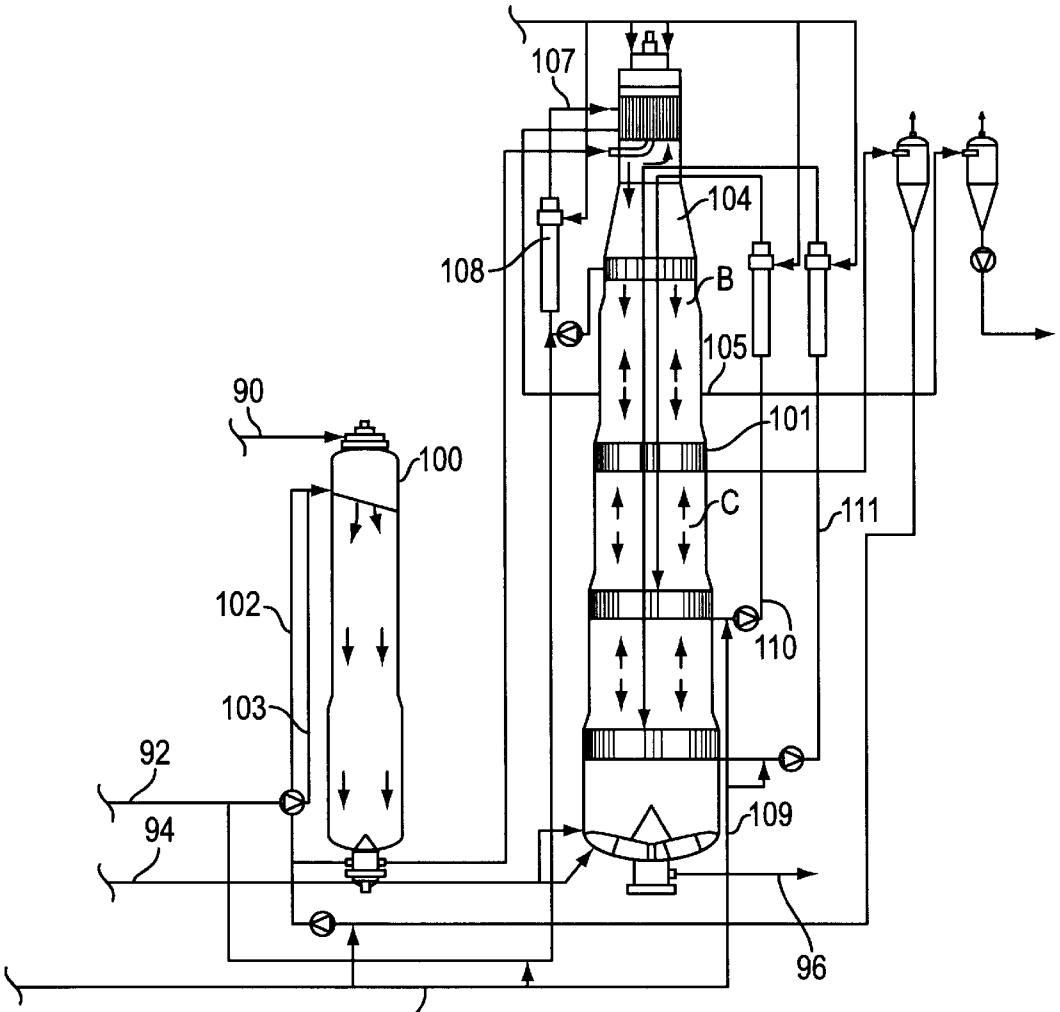
FIG. 2 shows a continuous two vessel steam/liquid-phase digester arrangement according to a preferred embodiment of the present invention.

An embodiment according to the present invention in which polysulfide liquor is added to the digester will now be described with reference to FIG. 2. FIG. 2 shows a continuous two vessel steam/liquid-phase digester arrangement according to a preferred embodiment of the invention. In this embodiment, the delignification rate is significantly increased at low temperatures by polysulfide cooking, in accordance with the following.

A cellulosic fiber material, such as wood chips, (90) is introduced into the top of the impregnation vessel (100). The top of the impregnation vessel includes a screw feeder which makes the chips move slowly downwards in a plug flow trough the impregnation vessel (100) in a liquor-to-wood ratio of from about 2:1 to about 10:1, preferably from about 3:1 to about 8:1, and more preferably from about 4:1 to about 7:1. Hot black liquor, which is extracted from the digester, through screen (101), is added, via conduit (102), together with less than about 20% , or possibly none, of the polysulfide liquor (92), which has been prepared according the previous description, via conduit (103), to the top of the impregnation vessel (100). When the polysulfide concentration in the black liquor is sufficient, no fresh polysulfide liquor is required. In this manner, the polysulfide liquor can be added as necessary to maintain a desired polysulfide level in the first cooking liquor.

In this example, the concentration of polysulfide in the total liquor added through the conduits (102) and (103), at the top of the impregnation vessel should be about 2.5 grams/liter or greater, and the effective alkali concentration (calculated as NaOH) should be about 15 grams/liter or greater. Extra alkali, if required, can be added through conduit (112), such as white liquor.

The temperature during the impregnation step should be from about 80 to about 140° C. for a period of about 20 to about 120 minutes. The chips, which have been thoroughly impregnated and partially delignified in the impregnation vessel, are fed to the top of the digester (104) and conveyed into the top separator. Preferably, at least a portion of black liquor is withdrawn from the top of the digester and led to evaporation through conduit (105). More than about 80% of the polysulfide liquor used in the process 26. shown in FIG. 2 is added to the top of the digester (104), via conduit (107). The polysulfide liquor is preferably heated by means of a heat exchanger (108). The concentration of polysulfide should be about 5 grams/liter or greater and the effective alkali concentration (calculated as NaOH) should be about 20 grams/liter or greater. Extra alkali, if required, can be added through conduit (112).

The chips then move down in zone (B) at a relatively low cooking temperature, for example, from about 120 to about 150° C., preferably from about 135 to about 148° C., and more preferably from about 140 to about 145° C. The retention time in this first cooking zone should be at least about 50 minutes, preferably at least about 60, and more preferably at least about 70 minutes. Laboratory tests have shown that the delignification rate is increased when polysulfide is present, see FIG. 3. The polysulfide is, however rapidly decomposed at high temperatures generally practiced in conventional Kraft cooking system, such as from about 160 to about 170° C. At a temperature of about 140° C., however, as much as 50% of the charged polysulfide remains after 120 minutes, see FIG. 4. The hot black liquor from the digester will, therefore contain a large concentration of polysulfides. This black liquor, with released lignin, a relatively high content of effective alkali, and remaining polysulfide is withdrawn through the screen (101) and is introduced at the top of the impregnation vessel via conduit (102) as described above. The alkaline content of this withdrawn black liquor (102) usually exceeds about 15 grams/liter. To achieve the desired alkali concentration in a preferred counter-current zone (C) in the digester, low sulfidity white liquor is added in two recirculation lines (110, 111). The alkali concentration demand in the cooking zone (C) is dependent on the desired lignin content of the produced pulp. The produced pulp is washed using a washing liquid supplied by conduit (94) and the washed pulp exits the digester through conduit (96).

While preferred embodiments and alternatives of the invention have been shown and described it will be understood that they are merely illustrative and that changes may be made without departing form the scope of the invention as claimed.

What is claimed is:

1. A process for producing pulp from cellulosic fiber material comprising the steps of:

(a) impregnating a cellulosic fiber material with a first cooking liquor comprising polysulfide, wherein said first cooking liquor provides about 60% or less of a total effective alkali utilized for cooking said cellulosic fiber material;

(b) cooking said cellulosic fiber material with a second cooking liquor in one or more cooking stages, wherein said second cooking liquor provides at least about 40% of the total effective alkali utilized for cooking said cellulosic fiber material;

(c) extracting a spent cooking liquor comprising sulfide compounds from at least one of said impregnating step (a) or said cooking step (b);

(d) gasifying at least a portion of said spent cooking liquor from step (c) in a gasification reactor to form a first gas stream comprising hydrogen sulfide;

(e) treating said first gas stream to form an acidic gas stream comprising hydrogen sulfide and carbon dioxide;

(f) reacting said acidic gas stream under conditions to provide a hot liquid stream of elemental sulfur;

(g) admixing at least a portion of said hot liquid, elemental sulfur stream with an alkaline liquor containing sulfide under conditions that the elemental sulfur reacts with the sulfide to form polysulfide, whereby an alkaline liquor containing at least about 10 grams/liter of polysulfide and which is substantially free of thiosulfate is formed; and (h) adding at least a portion of said alkaline polysulfide liquor to said first cooking liquor or directly to said impregnation step (a) to stabilize carbohydrates in the cellulosic fiber material.

2. A process according to claim 1, further comprising the step of recycling at least a portion of said spent liquor from step (c) to step (a) to provide at least a portion of said first cooking liquor.

3. A process according to claim 1, wherein said alkaline liquor containing sulfide in said step (g) comprises a white liquor.

4. A process according to claim 1, wherein said alkaline liquor containing sulfide in said step (g) comprises a green liquor.

5. A process according to claim 1, wherein said first cooking liquor provides about 40% or less of said total effective alkali, and said second cooking liquor comprises about 60% or more of said total effective alkali.

6. A process according to claim 1, wherein said step (g) is conducted to provide said alkaline liquor with a polysulfide concentration of from about 10 to about 100 grams/liter.

7. A process according to claim 1, wherein said step (g) is conducted to provide said alkaline liquor with a polysulfide concentration of from about 15 to about 40 grams/liter.

8. A process according to claim 1, further comprising the step of concentrating a portion of said spent cooking liquor to a dry solids content of from about 70 to about 85% before subjecting said portion of said spent liquor to gasification in said step (d).

9. A process according to claim 1, further comprising the step of gasifying said portion of spent liquor in a gasification reactor under conditions such that at least about 20% of the sulfur compounds charged to said gasification reactor are recovered as hydrogen sulfide in said gas stream.

10. A process according to claim 1, further comprising the step of steaming said cellulosic material at a temperature of from about 130 to about 175° C. for a period of from about 5 to about 30 minutes after said impregnation step (a).

11. A process for producing pulp from cellulosic fiber material comprising the steps of:

(a) impregnating a cellulosic fiber material with a first cooking liquor comprising polysulfide, wherein the first cooking liquor provides about 60% or less of a total effective alkali utilized for cooking the cellulosic fiber material;

(b) cooking the cellulosic fiber material with a second cooking liquor in one or more cooking stages under conditions such that at least about 30% of the polysulfide supplied to said cooking step (b) remains intact in a spent liquor following completion of cooking, wherein the second cooking liquor provides at least about 40% of the total effective alkali utilized for cooking the cellulosic fiber material;

(c) extracting a spent cooking liquor comprising said intact polysulfide and sulfide compounds from said cooking step (b);

(d) gasifying at least a portion of the spent cooking liquor extracted from step (c) or at least a portion of a spent liquor extracted after said impregnation step (a) in a gasification reactor to form a first gas stream comprising hydrogen sulfide;

(e) treating the first gas stream to form an acidic gas stream comprising hydrogen sulfide and carbon dioxide;

(f) reacting the acidic gas stream under conditions to provide a hot liquid stream of elemental sulfur;

(h) utilizing at least a portion of a spent liquor containing intact polysulfide from step (c) as the first cooking liquor, (g) admixing at least a portion of the hot liquid, elemental sulfur stream with an alkaline liquor containing sulfide under conditions that the elemental sulfur reacts with the sulfide to form polysulfide, whereby an alkaline polysulfide liquor containing at least about 10 grams/liter of polysulfide and which is substantially free of thiosulfate is formed;

(i) adding at least a portion of said alkaline polysulfide liquor from step (g) to said second cooking liquor or directly to said one or more cooking stages in step (b); and (j) adding a portion of said polysulfide liquor to said first cooking liquor or directly to said impregnation step (a) to provide a desired polysulfide concentration in said impregnation stage when an amount of polysulfide supplied by said spent cooking liquor in step (h) is below an amount sufficient to provide the desired polysulfide concentration in said impregnation stage.

12. A process according to claim 11, wherein said alkaline liquor comprises a white liquor.

13. A process according to claim 11, wherein said alkaline liquor comprises a green liquor.

14. A process according to claim 11, wherein said cooking conditions are such that at least about 40% of the polysulfide supplied to said cooking step (b) remains intact in said spent liquor following completion of cooking.

15. A process according to claim 11, wherein said desired polysulfide concentration is sufficient to provide carbohydrate stabilization.

16. A process according to claim 11, wherein said cooking conditions comprise cooking at a temperature of from about 120 to about 150° C.

17. A process according to claim 11, wherein said cooking conditions comprise cooking at a temperature of from about 140 to about 145° C.

18. A process according to claim 11, wherein about 20% or less of said alkaline polysulfide liquor is added to said impregnation step (a) and about 80% or more of said alkaline polysulfide liquor is added to said cooking step (b).

19. A process according to claim 11, wherein said step (g) is conducted to provide said alkaline liquor with a polysulfide concentration of from about 10 to about 100 grams/liter.

20. A process according to claim 11, wherein said step (g) is conducted to provide said alkaline liquor with a polysulfide concentration of from about 15 to about 40 grams/liter.

21. A process according to claim 11, further comprising the step of concentrating a portion of said spent cooking liquor to a dry solids content of from about 70 to about 85% before subjecting said portion of said spent liquor to gasification in said step (d).

22. A process according to claim 11, further comprising the step of gasifying said portion of spent liquor in a gasification reactor under conditions such that at least about 20% of the sulfur compounds charged to said gasification reactor are recovered as hydrogen sulfide in said gas stream.

23. A process according to claim 11, further comprising the step of steaming said cellulosic material at a temperature of from about 130 to about 150° C. for a period of from about 5 to about 30 minutes after said impregnation step (a).

* * * * *